US010420684B2

(12) United States Patent
Dietz et al.

(10) Patent No.: US 10,420,684 B2
(45) Date of Patent: Sep. 24, 2019

(54) ASSISTED LIFTING DEVICES FOR ROLL-IN-COTS

(71) Applicant: Ferno-Washington, Inc., Wilmington, OH (US)

(72) Inventors: Timothy Dietz, Springboro, OH (US); Brian Magill, Cincinnati, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 774 days.

(21) Appl. No.: 14/896,040

(22) PCT Filed: Jun. 12, 2014

(86) PCT No.: PCT/US2014/042088
§ 371 (c)(1),
(2) Date: Dec. 4, 2015

(87) PCT Pub. No.: WO2014/201228
PCT Pub. Date: Dec. 18, 2014

(65) Prior Publication Data

US 2016/0128881 A1 May 12, 2016

Related U.S. Application Data

(60) Provisional application No. 61/835,039, filed on Jun. 14, 2013.

(51) Int. Cl.
*A61G 1/056* (2006.01)
*A61G 1/013* (2006.01)
*A61G 1/02* (2006.01)

(52) U.S. Cl.
CPC ..... *A61G 1/0562* (2013.01); *A61G 1/013* (2013.01); *A61G 1/0212* (2013.01);
(Continued)

(58) Field of Classification Search
CPC ..... A61G 1/048; A61G 1/0562; A61G 1/013; A61G 1/0212; A61G 1/0256; A61G 1/0243; A61G 1/0262
See application file for complete search history.

(56) References Cited

U.S. PATENT DOCUMENTS 2,386,767 A * 10/1945 Arens ..... G05G 5/24 411/403
2,788,529 A * 4/1957 Moritzacky ..... A61G 7/015 5/614

(Continued)

OTHER PUBLICATIONS

International Search Report pertaining to Application No. PCT/US2014/042088 with a filing date of Jun. 12, 2014.

(Continued)

*Primary Examiner* — Peter M. Cuomo
*Assistant Examiner* — Ifeolu A Adeboyejo
(74) *Attorney, Agent, or Firm* — Dinsmore & Shohl, LLP

(57) ABSTRACT

Roll-in cots having lift assist mechanisms and lift assist mechanisms are disclosed. According to one embodiment, a lift assist mechanism includes a force application member having an actuation element, an actuation mechanism comprising a first grasp handle and a second grasp handle, and a force transmission assembly. The force transmission assembly includes a first keyway plate that is coupled to the first grasp handle, a second keyway plate that is coupled to the second grasp handle, and an actuation pin that extends through both the first keyway plate and the second keyway plate, where the actuation pin selectively applies a force to the actuation element of the force application member.

7 Claims, 5 Drawing Sheets

(52) U.S. Cl.
CPC ..... *A61G 1/0256* (2013.01); *A61G 1/0243* (2013.01); *A61G 1/0262* (2013.01)

(56) References Cited

U.S. PATENT DOCUMENTS 2,819,475 A * 1/1958 Ericsson ..... A61G 7/015 5/614
3,284,126 A * 11/1966 Piazza ..... A47C 17/163 280/657
4,002,330 A * 1/1977 Johansson ..... A61G 7/0005 5/428
4,222,131 A * 9/1980 Holdt ..... A47C 20/042 5/617
4,489,449 A * 12/1984 Failor ..... A61G 7/00 5/83.1
4,751,755 A * 6/1988 Carey, Jr. ..... A61G 7/002 5/614
4,767,148 A * 8/1988 Ferneau ..... A61G 1/0567 296/20
4,858,260 A * 8/1989 Failor ..... A61G 5/006 5/618
4,913,460 A * 4/1990 Klein ..... B62B 1/045 224/274
4,945,582 A * 8/1990 Hayton ..... A61G 5/006 297/423.26
D311,509 S * 10/1990 Failor ..... D12/131
4,970,737 A 11/1990 Sagel
5,372,559 A * 12/1994 Dalebout ..... A63B 22/0023 248/649
5,402,543 A * 4/1995 Dietrich ..... A61G 7/015 5/610
5,435,027 A * 7/1995 Bourgraf ..... A61G 1/0567 296/20
5,537,700 A * 7/1996 Way ..... A61G 1/0567 296/20
5,662,557 A * 9/1997 Watterson ..... A63B 22/0012 482/54
5,672,140 A * 9/1997 Watterson ..... A63B 22/0012 482/54
5,674,156 A * 10/1997 Watterson ..... A63B 22/0012 482/54
5,674,453 A * 10/1997 Watterson ..... A63B 22/0012 482/54
5,676,624 A * 10/1997 Watterson ..... A63B 22/0012 482/54
5,699,567 A * 12/1997 Sanders ..... A61G 5/006 5/614
5,926,876 A * 7/1999 Haigh ..... A61G 13/12 5/616
5,987,673 A * 11/1999 Smith ..... A61G 1/0293 16/113.1
6,053,064 A * 4/2000 Gowing ..... F16C 1/16 29/453
6,076,208 A * 6/2000 Heimbrock ..... A61G 7/00 5/183
6,276,010 B1 * 8/2001 Way ..... A61G 1/0565 5/11
6,568,008 B2 * 5/2003 Siepmann ..... A61G 13/0018 5/617
6,702,305 B2 * 3/2004 Miles ..... B25H 5/00 280/32.5
7,389,552 B1 * 6/2008 Reed ..... A61G 1/013 296/20
7,475,944 B2 * 1/2009 Griepentrog ..... A47C 17/175 297/328
7,600,817 B2 * 10/2009 Kramer ..... A47C 1/022 297/354.13
7,882,583 B2 * 2/2011 Skripps ..... A61G 13/04 5/621
7,917,978 B2 * 4/2011 Ruschke ..... A61G 7/0507 5/428
8,104,122 B2 * 1/2012 Richards ..... A61G 7/05 5/600
2002/0157185 A1 * 10/2002 Heimbrock ..... A61G 7/015 5/618
2006/0031990 A1 * 2/2006 Palmatier ..... A61G 7/015 5/611
2006/0075558 A1 * 4/2006 Lambarth ..... A61G 1/0212 5/611
2007/0000056 A1 * 1/2007 Ward ..... A61G 1/013 5/611
2007/0000057 A1 * 1/2007 Ward ..... A61G 1/0293 5/611
2007/0180621 A1 8/2007 Turner et al.
2007/0216117 A1 * 9/2007 Figel ..... A61G 1/0225 280/47.38
2009/0165207 A1 * 7/2009 Reed ..... A61G 1/013 5/611
2009/0222988 A1 * 9/2009 Reed ..... A61G 1/0567 5/627
2011/0083272 A1 * 4/2011 Childs ..... A61G 1/048 5/616

OTHER PUBLICATIONS

Written Opinion pertaining to Application No. PCT/US2014/042088 with a filed dated of Jun. 12, 2014.
Examination Report pertaining to Australian patent application No. 2014278148 dated, Sep. 1, 2017.
Japanese First Official Action received May 31, 2018 relating to JP 2016-519641.

* cited by examiner

ASSISTED LIFTING DEVICES FOR ROLL-IN-COTS

CROSS-REFERENCE TO RELATED APPLICATIONS

The present application claims priority to and the benefit of U.S. Provisional Application 61/835,039 filed 14 Jun. 2013, the entirety of which is incorporated by reference herein.

TECHNICAL FIELD

The present disclosure is generally related to emergency cots, and is specifically directed to roll-in cots having assisted lifting devices for articulating a portion of a stretcher.

BACKGROUND ART

There are a variety of emergency cots in use today. Such emergency cots may be designed to transport and load patients into an ambulance.

Conventional cot designs may include a variety of adjustments to improve patient comfort or to position the patent for improved medical treatment. However, some of these adjustments may be difficult for the caregiver to adjust, or may not provide the care giver with enough flexibility in positioning the cot as desired to address the particular patient's needs.

Accordingly, roll-in cots having various repositioning elements may be desired.

SUMMARY OF INVENTION

The embodiments described herein address are directed to a versatile multipurpose roll-in emergency cot which may provide improved adjustability of components of the cot while maintaining the cot weight, complexity, and cost.

According to various embodiments, a roll-in cot includes a support frame, a stretcher coupled to the support frame, where the stretcher has a torso portion coupled to a hips portion with a hinge, and a lift assist mechanism coupled to the support frame and the torso portion of the stretcher. The lift assist mechanism includes a force application member having an actuation element, an actuation mechanism having a first grasp handle and a second grasp handle, and a force transmission assembly coupling the first grasp handle and the second grasp handle to the actuation element of the force application member for selective engagement with the actuation element. The force transmission assembly includes a first keyway plate coupled to the first grasp handle, a second keyway plate coupled to the second grasp handle, and an actuation pin that selectively applies force to the actuation element of the force application member when selected by one or both of the first keyway plate or the second keyway plate.

According to another embodiment, a lift assist mechanism includes a force application member having an actuation element, an actuation mechanism comprising a first grasp handle and a second grasp handle, and a force transmission assembly. The force transmission assembly includes a first keyway plate that is coupled to the first grasp handle, a second keyway plate that is coupled to the second grasp handle, and an actuation pin that extends through both the first keyway plate and the second keyway plate, where the actuation pin selectively applies a force to the actuation element of the force application member.

According to yet another embodiment, a lift assist mechanism includes a force application member having an actuation element, an actuation mechanism having a first grasp handle and a second grasp handle, and a force transmission assembly. The force transmission assembly includes a first keyway plate that is coupled to the first grasp handle, a second keyway plate that is coupled to the second grasp handle, and an actuation pin that extends through both the first keyway plate and the second keyway plate. The actuation pin selectively applies a force to the actuation element of the force application member. The first keyway plate and the second keyway plate are both repositionable between a relaxed position and an actuation position. Each of the first keyway plate and the second keyway plate comprise a keyway having an actuation portion and a relief portion, and the first keyway plate and the second keyway plate are located in the actuation position when the actuation pin is positioned proximate to the actuation portion of the keyway. A portion of the first keyway plate that contacts the actuation pin as the first keyway plate translates between a relaxed position and the actuation position is transverse to the direction of translation of the first keyway plate.

These and additional features provided by the embodiments of the present disclosure will be more fully understood in view of the following detailed description, in conjunction with the drawings.

BRIEF DESCRIPTION OF DRAWINGS

The following detailed description of specific embodiments of the present disclosures can be best understood when read in conjunction with the following drawings, where like structure is indicated with like reference numerals and in which.

Figure 1:
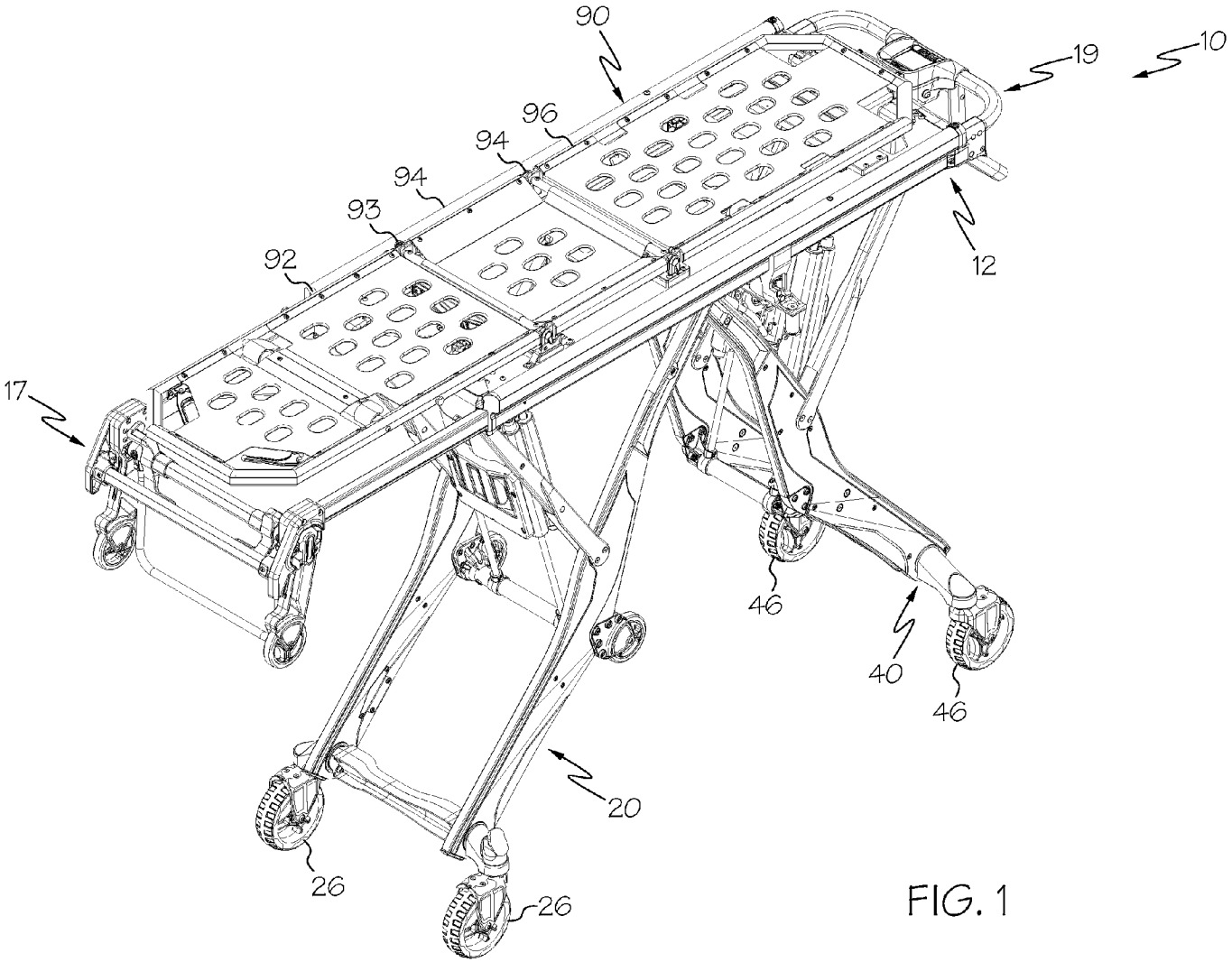
FIG. 1 is a top perspective view depicting a roll-in cot according to one or more embodiments shown or described herein.

The embodiments set forth in the drawings are illustrative in nature and not intended to be limiting of the embodiments described herein. Moreover, individual features of the drawings and embodiments will be more fully apparent and understood in view of the detailed description.

DESCRIPTION OF EMBODIMENTS

Roll-in cots that are used to transport patients may have a variety of repositionable support members that allow the patient to be supported in a variety of positions. To support the patient in a position other than a flat prone or supine position, the repositionable support members of the roll-in cots may be articulated into partially or completely elevated orientations such that the corresponding body portion of the patient is maintained in a partially or completely elevated orientations. The roll-in cots may incorporate at least one lift assist mechanism that selectively applies a force to at least one of the repositionable support members so that the repositionable support members can more easily be articulated or repositioned throughout their range of motion.

In some instances, the service provider who is assisting the patient on roll-in cot may not have both hands free to actuate the lift assist mechanism. Embodiments according to the present disclosure allow the service provider to use one of multiple grasp handles to actuate a single lift assist mechanism, thereby allowing the service provider to actuate the lift assist mechanism with one or two hands that the service provider has free at a particular time. These and other elements of the embodiments according to the present disclosure will be discussed in greater detail below.

Referring to FIG. 1, a roll-in cot 10 for transport and loading is shown. The roll-in cot 10 includes a support frame 12 comprising a front end 17, and a back end 19. As used herein, the front end 17 is synonymous with the loading end, i.e., the end of the roll-in cot 10 which is loaded first onto a loading surface. Conversely, as used herein, the back end 19 is the end of the roll-in cot 10 which is loaded last onto a loading surface. Additionally it is noted, that when the roll-in cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse, and the like.

The roll-in cot 10 also includes a pair of retractable and extendible front legs 20 coupled to the support frame 12, and a pair of retractable and extendible back legs 40 coupled to the support frame 12. The roll-in cot 10 may be made from any rigid material such as, for example, metal structures or composite structures. Specifically, the support frame 12, the front legs 20, the back legs 40, or combinations thereof may be made from a carbon fiber and resin structure or a fiberglass and resin structure. The roll-in cot 10 may be raised to multiple heights by extending the front legs 20 and/or the back legs 40, or the roll-in cot 10 may be lowered to multiple heights by retracting the front legs 20 and/or the back legs 40. It is noted that terms such as "raise," "lower," "above," "below," and "height" are used herein to indicate the distance relationship between objects measured along a line parallel to gravity using a reference (e.g. a surface supporting the cot). Additionally, the front legs 20 and the back legs 40 may comprise front wheels 26 and back wheels 46 which enable the roll-in cot 10 to roll.

In one embodiment, the front wheels 26 and back wheels 46 may be swivel caster wheels or swivel locked wheels. As is described below, as the roll-in cot 10 is raised and/or lowered, the front wheels 26 and back wheels 46 may be synchronized to ensure that the plane of the roll-in cot 10 and the plane of the wheels 26, 46 are substantially parallel. For example, the back wheels 46 may each be coupled to a back wheel linkage 47 and the front wheels 26 may each be coupled to a front wheel linkage 27. As the roll-in cot 10 is raised and/or lowered, the front wheel linkages 27 and the back wheel linkages 47 may be rotated to control the plane of the wheels 26, 46.

The roll-in cot 10 includes a stretcher 90 that is positioned along the top of the support frame 12. In some embodiments, the stretcher 90 may be selectively coupled to the support frame 12 so that the stretcher 90 may be removed from the support structure of the roll-in cot 10, including the support frame 12, the front legs 20, and the rear legs 40. The stretcher 90 may further include a mattress positioned on top of the stretcher surfaces, but which is not depicted for clarity of other roll-in cot 10 components.

The stretcher 90 may include a plurality of portions that are coupled to one another. In the embodiment depicted in FIG. 1, the stretcher 90 includes a torso portion 92, a hip portion 94, and a leg portion 96, which correspond to the torso, hips, and legs, respectively, of a patient positioned on the stretcher 90 in a supine position. The torso portion 92, the hip portion 94, and the leg portion 96 may be coupled to one another with a variety of components that provide the desired functional relationship between the torso portion 92, the hip portion 94, and the leg portion 96. In the embodiment depicted in FIG. 1, the torso portion 92 is coupled to the hip portion 94 through a first hinge 93. Similarly, the hip portion 94 is coupled to the leg portion 96 through a second hinge 95. The first hinge 93 and the second hinge 95 allow the torso portion 92 and the leg portion 96 to articulate relative to the hip portion 94, respectively. The torso portion 92 may be rotated relative to the hip portion 94 so that the torso portion 92 is located in positions corresponding to the patient sitting in an upright, seated orientation. Similarly, the leg portion 96 may be rotated relative to the hip portion 94 so that the leg portion 96 is located in positions corresponding to the patient having inclined legs.

Figure 2:
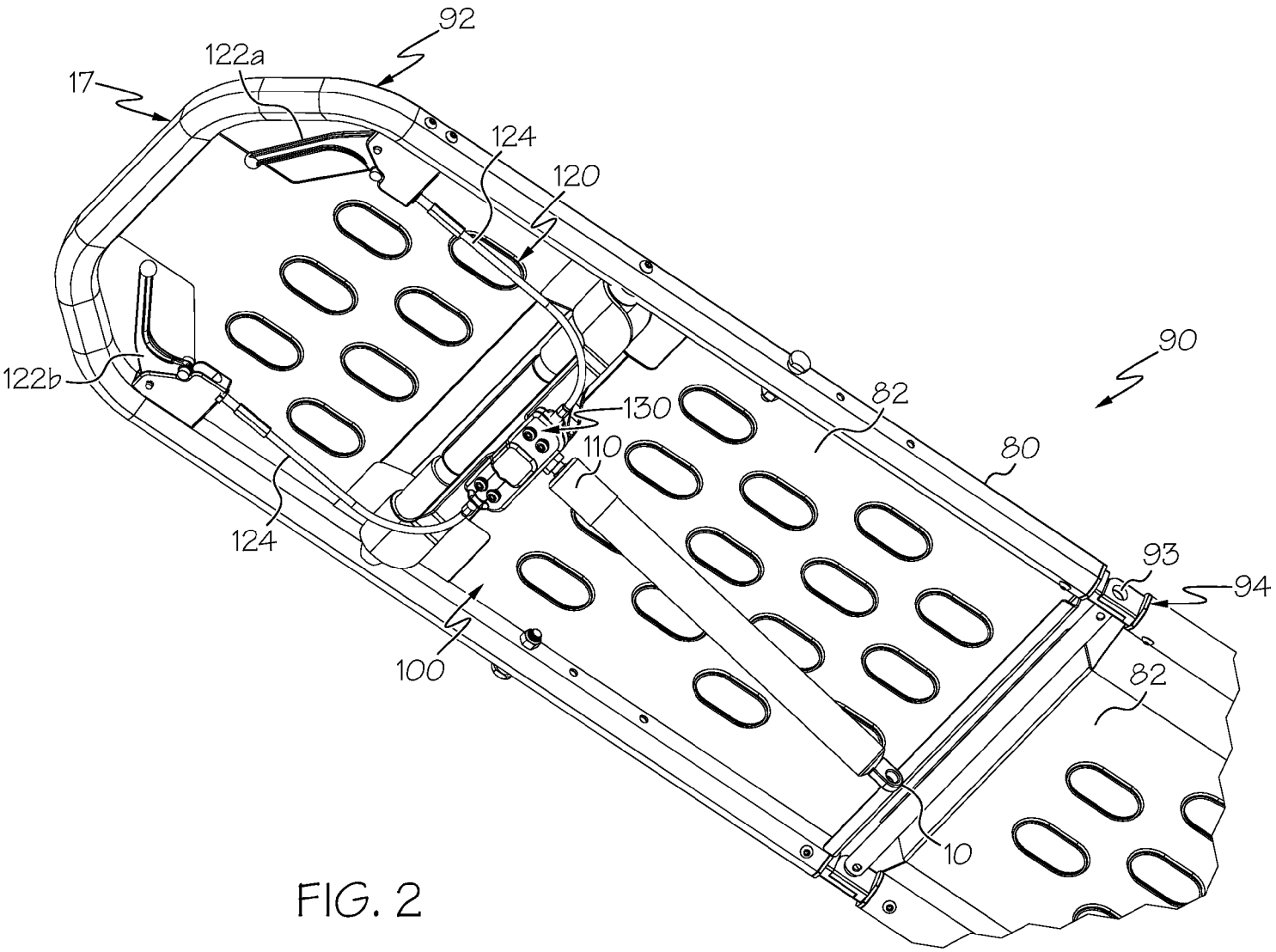
FIG. 2 is a bottom perspective view of a portion of an adjustable backrest for a roll-in cot according to one or more embodiments shown or described herein.
Figure 3:
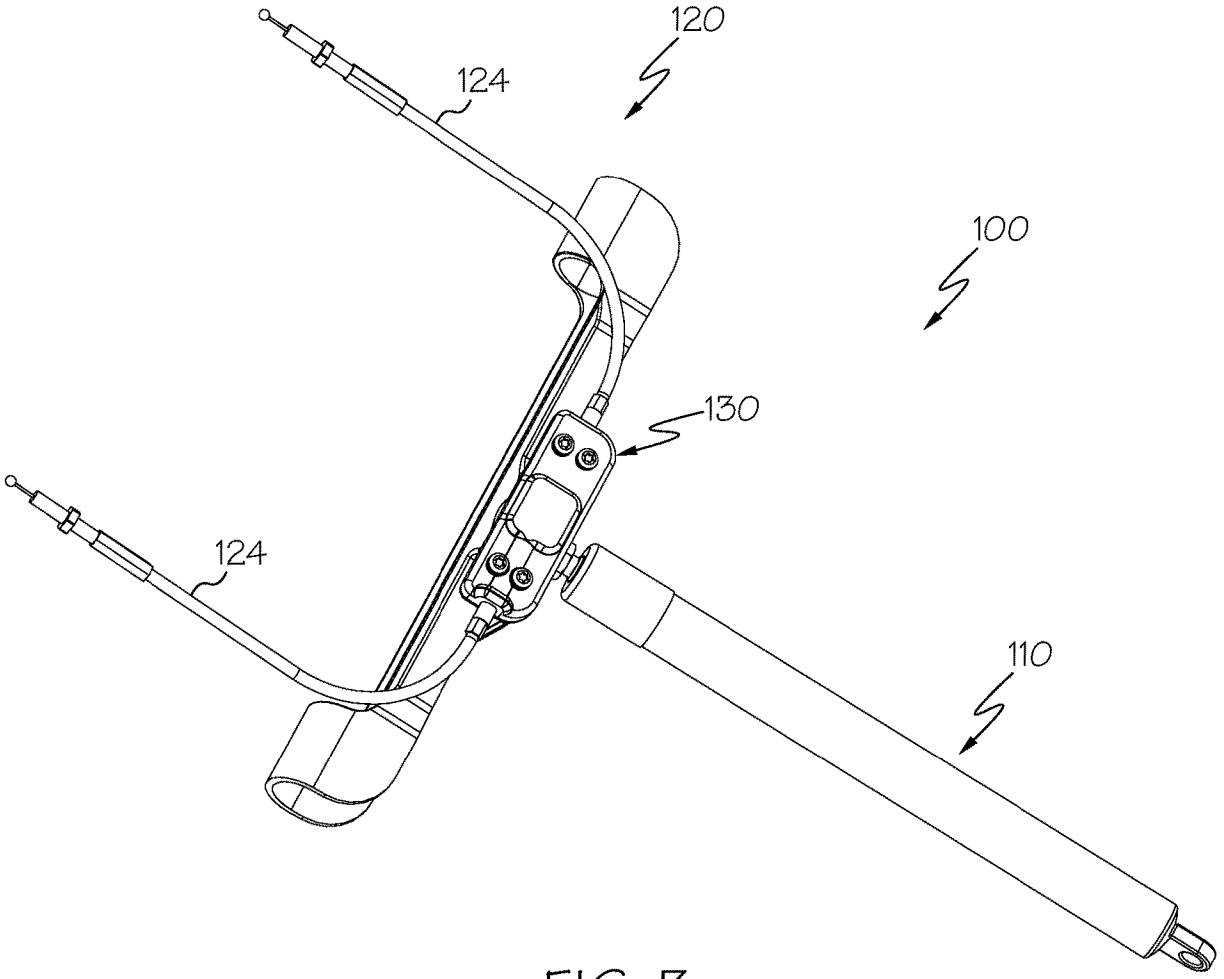
FIG. 3 is a top perspective view of a positioning assembly for an adjustable backrest according to one or more embodiments shown or described herein.

Referring now to FIGS. 2 and 3, the stretcher 90 is depicted in a view from below, with components of the roll-in cot 10 removed. In this view, underside structure of the stretcher 90 may be viewed. The stretcher 90 includes a space frame 80 that defines the general exterior dimensions of the stretcher 90 and a support material 82 positioned along interior portions of the space frame 80. When the patient is positioned on the stretcher 90, the patient contacts the support material 82 (or the mattress positioned on the support material (not shown)) so that the patient's weight is distributed to the space frame 80 of the stretcher 90. The stretcher 90 includes at least one lift assist mechanism 100. In the embodiment depicted in FIG. 2, the lift assist mechanism 100 is coupled to the torso portion 92 of the stretcher 90 and to the additional structure of the roll-in cot 10 (which is generally depicted in FIG. 1). Other embodiments of the roll-in cot 10 may incorporate a lift assist mechanism 100 that is coupled to the leg portion 86 (shown in FIG. 1) of the stretcher 90. The lift assist mechanism provides force that tends to assist in the articulation of the respective portion of the stretcher 90 so that the portion of the stretcher can be easily articulated between elevated and flat configurations.

The lift assist mechanism 100 includes a force application member 110 (for example, a pressurized gas cylinder) that is adapted to selectively provide a force that tends to extend the force application member 110. When so actuated by a user of the roll-in cot 10, the force application member 110 provides a force that tends to raise the torso portion 92 of the stretcher 90 towards an elevated position relative to the hip portion 94 of the stretcher 90. The force application member 100 may provide a force that overcomes at least some of the force associated with the weight of the torso portion 92 of the stretcher 90, and may provide a force that overcomes at least some of the force associated with the weight of the patient's torso positioned proximate to and supported by the torso portion 92 of the stretcher 90.

The lift assist mechanism 100 also includes an actuation mechanism 120. In the embodiment depicted in FIGS. 2 and 3, the actuation mechanism 120 includes two grasp handles 122 (i.e., a first grasp handle 122*a* and a second grasp handle 122*b*) that are positioned proximate to the space frame 80 at locations proximate to the front end 17 of the roll-in cot 10. The stretcher 90 includes clearance within the support material 82 so that a user of the roll-in cot 10 may selectively digitally contact and actuate at least one of the grasp handles 122 when a patient is positioned on the top surface of the stretcher 90. The first grasp handle 122*a* and the second grasp handle 122*b* are mechanically coupled to a force transmission assembly 130 through a first linkage 124*a* or a second linkage 124*b*, respectively. In the embodiment depicted in FIGS. 2 and 3, the linkages 124 are cable-based systems having a flexible cable that runs along the length of a jacket. When a user applies force to and translates one of the grasp handles 122, the grasp handle 122 translates the force through the respective linkage 124 (i.e., the first linkage 124*a* or the second linkage 124*b*) and along the flexible cable, which directs the force into the force transmission assembly 130. Examples of apparatuses suitable for use as the linkage 124 include pull cables, push-pull cables, rod-and-ball end mechanical linkages, and the like. The force transmission assembly 130 redirects the force imparted from the linkage 124 to actuate the force application member 110, as will be described in greater detail below.

Figure 4:
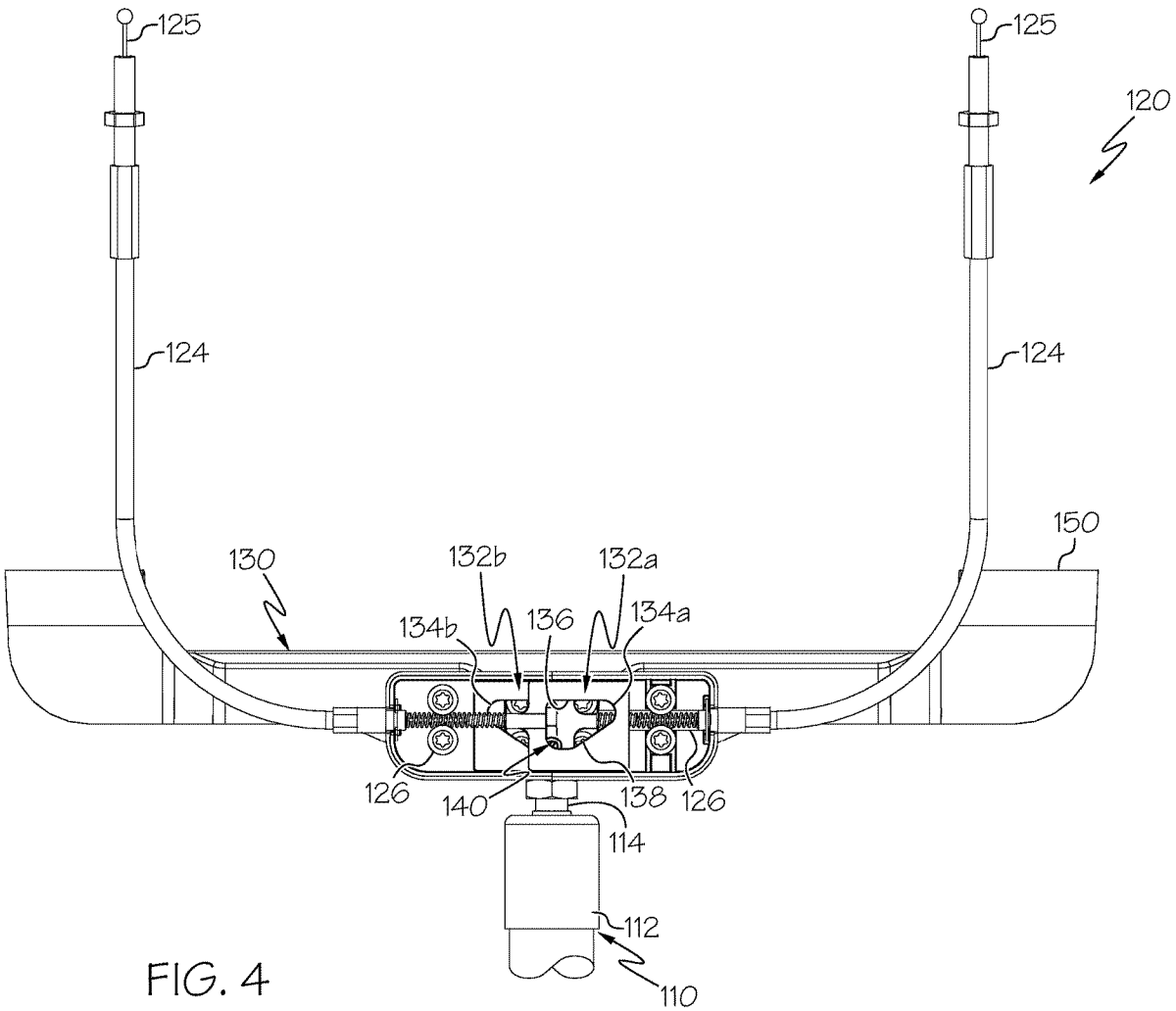
FIG. 4 is a top view of a positioning assembly for an adjustable backrest according to one or more embodiments shown or described herein.
Figure 5:
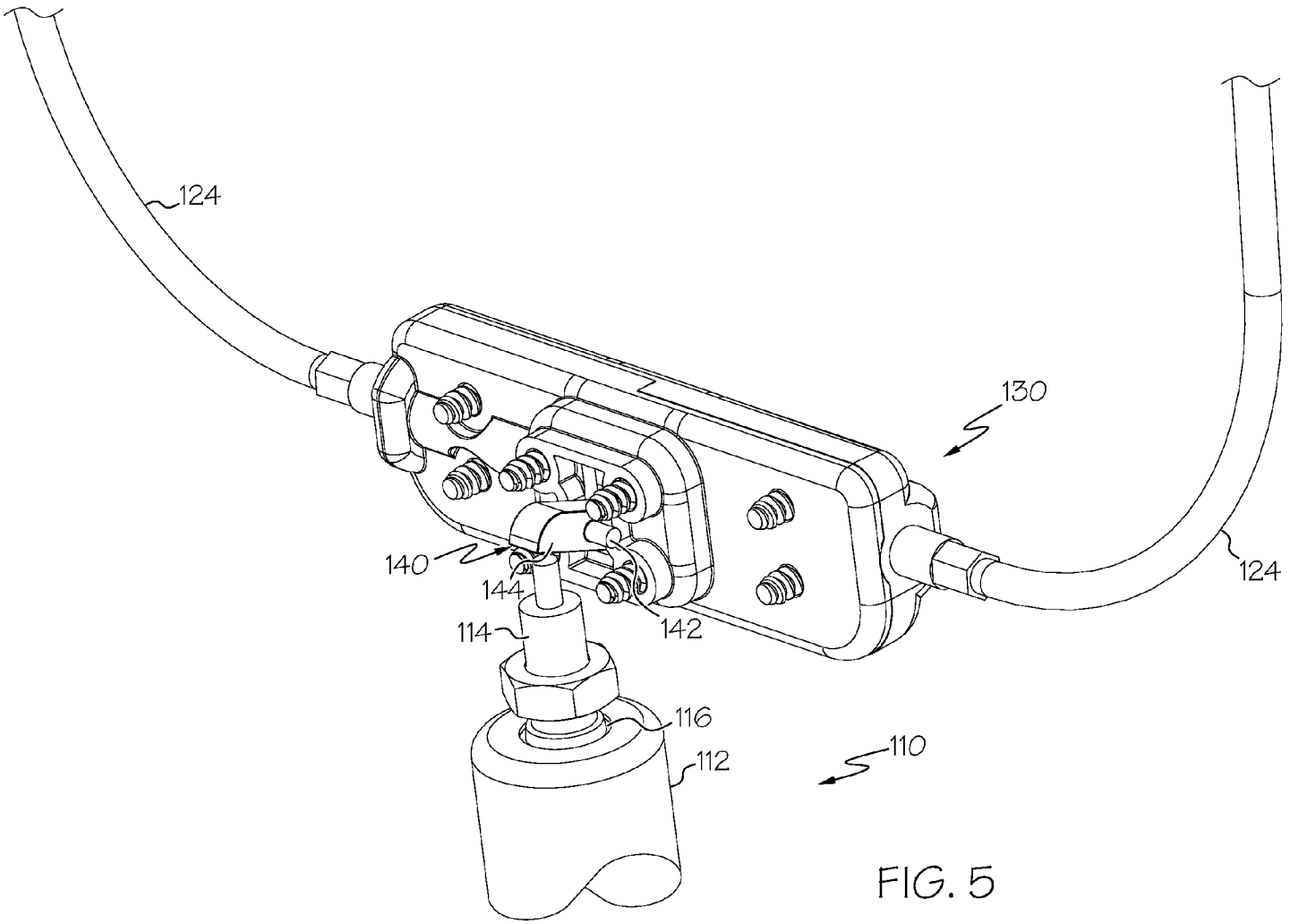
FIG. 5 is a bottom perspective view of a positioning assembly for an adjustable backrest according to one or more embodiments shown or described herein.

Referring now to FIGS. 4 and 5, the actuation mechanism 120 is shown in greater detail, along with the force application member 110 of the lift assist mechanism 100. As depicted in FIG. 4, force applied to the grasp handles 122 (shown in FIGS. 2 and 3) is directed along the linkage 124 into the force transmission assembly 130. In the embodiment depicted in FIGS. 4 and 5, force applied to the one of the first or second linkages 124*a*, 124*b* translates a cable 125 within the jacket and translates a respective first keyway plate 132*a* or a second keyway plate 132*b*. Each of the first keyway plate 132*a* and the second keyway plate 132*b* includes a first keyway 134*a* or a second keyway 134*b* that passes through the respective first or second keyway plate 132*a*, 132*b*. Each of the first keyway 134*a* and second keyway 134*b* have a designated shape that includes a relief portion 136 and an actuation portion 138. As depicted in FIGS. 4 and 5, the actuation portion 138 of the keyway 134*a*, 134*b* has a larger opening size relative to the relief portion 136. The portion of the perimeter of each of the first and second keyways 134*a*, 134*b*, evaluated between the relief portion 136 and the actuation portion 138, is positioned transverse to to the direction of translation of the first or second keyway plate 132*a*, 132*b* between the relaxed position and the actuation position. As depicted in FIGS. 4 and 5, the portion of the perimeter of each of the first and second keyways 134*a*, 134*b*, evaluated between the relief portion 136 and the actuation portion 138, is positioned transverse to the direction of translation of the first or second keyway plate 132*a*, 132*b* between the relaxed position and the actuation position. The force transmission assembly 130 also includes an actuation pin 140 that is at least partially positioned within the keyway 134 of both of the first and second keyway plates 132*a*, 132*b*. In the embodiments depicted in FIGS. 4 and 5, the actuation pin 140 simultaneously extends through both the first and second keyway plates 132*a*, 132*b*.

It should be noted that the shape of the portion of the perimeter of each of the first and second keyways 134*a*, 134*b*, evaluated between the relief portion 136 and the actuation portion 138, modifies the speed of translation of the actuation pin 140. The shape of the first and second keyways 134*a*, 134*b* may be modified, therefore, based on the desired rate of translation of the actuation pin 140 relative to the force application member 110.

In the embodiment depicted in FIGS. 4 and 5, each of the first and second linkages 124*a*, 124*b* is coupled to a respective first or second keyway plate 132*a*, 132*b*. The first keyway plate 132*a* and the second keyway plate 132*b* are each adapted to translate within the force transmission assembly 130 independently of one another. When a user applies force to one or both of the first or second grasp handles 122*a*, 122*b*, the respective linkage translates the respective first or second keyway plate 132*a*, 132*b* within the force transmission assembly 130 from a relaxed position (where the actuation pin 140 is positioned proximate to the relief portion 136) towards an actuation position (where the actuation pin 140 is positioned proximate to the actuation portion 138). As the actuation pin 140 is brought into contact with the actuation portion 138 of at least one of the first or second keyway plates 132*a*, 132*b*, the actuation portion 138 of one or both of the first or second keyway plates 132*a*, 132*b* translates the actuation pin 140 according to the profile of the actuation portion 138. Translation of the actuation pin 140 relative to an actuation element 114 of the force application member 110 selectively applies force to the actuation element 114 when so selected by the first or second keyway plate 132*a*, 132*b*. In the embodiment depicted in FIGS. 4 and 5, the actuation pin 140 includes a pivot portion 142 that is positioned within a transmission mount 150. When actuated by at least one of the keyway plates 132*a*, 132*b*, the actuation pin 140 tends to rotate about the pivot portion 142 and a pivot housing within the transmission mount 150.

Referring to the embodiment depicted in FIG. 5, as the actuation pin 140 rotates about the pivot portion 142, a striker portion 144 of the actuation pin 140 contacts an actuation element 114 of the force application member 110, thereby initiating a piston 116 of the force application member 110 to extend from the surrounding cylinder 112, as is conventionally known. It should be understood that applying forces to the grasp handles 122*a*, 122*b* to translate the first or second keyway plates 132*a*, 132*b* from the relaxed position to the actuation position may alternatively bring the actuation pin 140 out of contact with the actuation element 114 to modify the application of force by the force application member 110.

Referring again to FIG. 4, the force transmission assembly 130 may include a return mechanism 126 that applies a biasing force to the linkage 124 opposite in direction to the force applied to the grasp handles 122 by a user. As depicted here, the return mechanism 126 includes coil springs that apply a force to the cable 125 of the linkage 124 that tends to translate the keyway plates 132 towards the relaxed position so that when no external force is applied to the linkage 124 by a user, the actuation pin 140 is positioned proximate to the relief portion 136 of the keyway 134. The return mechanism 126 therefore prevents the actuation pin 140 from contacting the actuation element 114 of the force application member 110 when no force is applied to the grasp handles 122.

Actuation mechanism 120 according to the present disclosure allow for single-handed actuation of the lift assist mechanism 100 while providing provisions for dual-handed operation, so that a user of the roll-in cot 10 may selectively actuate the lift assist mechanism 100 with either hand. The actuation mechanism 120 may therefore enable simple operation of the lift assist mechanism 100 at times when dual-handed selective operation may be difficult.

It should now be understood that the embodiments described herein may be utilized to assist with the articulation of portions of a stretcher of a roll-in cot. The lift assist mechanism includes a force transmission assembly that allows for single-handed operation of the lift assist mechanism while maintaining multiple interfaces for a user to actuate the lift assist mechanism.

It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

The invention claimed is:

1. A roll-in cot comprising:

a support frame;

a stretcher coupled to the support frame, the stretcher comprising a torso portion coupled to a hips portion; and a lift assist mechanism coupled to the support frame and the torso portion of the stretcher, the lift assist mechanism comprising:

a force application member comprising an actuation element;

an actuation mechanism comprising a first grasp handle and a second grasp handle;

a force transmission assembly coupling the first grasp handle and the second grasp handle to the actuation element of the force application member for selective engagement with the actuation element, the force transmission assembly comprising a first keyway plate coupled to the first grasp handle, a second keyway plate coupled to the second grasp handle, and an actuation pin that extends through both the first keyway plate and second keyway plate and selectively applies force to the actuation element of the force application member when selected by one or both of the first keyway plate and the second keyway plate; and the first keyway plate and the second keyway plate are both repositionable between a relaxed position and an actuation position.

2. The roll-in cot of claim 1, wherein the first keyway plate is coupled to the first grasp handle by a first linkage, and the second keyway plate is coupled to the second grasp handle by a second linkage.

3. The roll-in cot of claim 1, wherein each of the first keyway plate and the second keyway plate comprise a keyway having an actuation portion and a relief portion, and the first keyway plate and the second keyway plate are located in an actuation position when the actuation pin is positioned proximate to the actuation portion of the keyway.

4. The roll-in cot of claim 3, wherein the actuation pin applies a force to the actuation element of the force application member when one or both of the first keyway plate or the second keyway plate is located in the actuation position.

5. The roll-in cot of claim 3, wherein a portion of the first keyway plate that contacts the actuation pin as the first keyway plate translates between the relaxed position and the actuation position is transverse to the direction of translation of the first keyway plate.

6. The roll-in cot of claim 1, further comprising a return mechanism that applies a biasing force to the first keyway plate in a direction corresponding to returning the first keyway plate to the relaxed position.

7. The roll-in cot of claim 1, wherein the force application member is a pressurized gas cylinder.

* * * * *